US009557715B2

(12) United States Patent
Goldmann

(10) Patent No.: US 9,557,715 B2
(45) Date of Patent: Jan. 31, 2017

(54) TIMEPIECE COMPRISING A REPEATER MECHANISM AND A CONTROL MECHANISM WITH AN INTEGRATED RELEASE LOCK

(71) Applicant: Glashuetter Uhrenbetrieb GmbH, Glashuette/Sachsen (DE)

(72) Inventor: Silko Goldmann, Duerrroehrsdorf (DE)

(73) Assignee: Glashuetter Uhrenbetrieb GmbH, Glashuette/Sachsen (DE)

( * ) Notice: Subject to any disclaimer, the term of this patent is extended or adjusted under 35 U.S.C. 154(b) by 0 days.

(21) Appl. No.: 15/070,634

(22) Filed: Mar. 15, 2016

(65) Prior Publication Data

US 2016/0274548 A1 Sep. 22, 2016

(30) Foreign Application Priority Data

Mar. 18, 2015 (EP) ..... 15159705

(51) Int. Cl.
*G04B 21/02* (2006.01)
*G04B 21/06* (2006.01)
*G04B 21/12* (2006.01)

(52) U.S. Cl.
CPC ..... *G04B 21/02* (2013.01); *G04B 21/06* (2013.01); *G04B 21/12* (2013.01)

(58) Field of Classification Search
CPC ..... G04B 21/02; G04B 21/06; G04B 21/12; G04B 21/14; G04B 23/023
See application file for complete search history.

(56) References Cited

U.S. PATENT DOCUMENTS 3,440,816 A * 4/1969 Jaccard ..... G04B 23/10 368/248
4,508,456 A * 4/1985 Hepfer ..... G04B 21/10 368/262
7,021,819 B2 * 4/2006 Schmiedchen ..... G04B 23/02 368/147
7,065,005 B2 * 6/2006 Rochat ..... G04B 23/12 368/250

(Continued)

FOREIGN PATENT DOCUMENTS

CH 61476 10/1913
CH 684 455 9/1994

(Continued)

OTHER PUBLICATIONS

European Search Report issued Oct. 29, 2015 in European Application 15159705, filed on Mar. 18, 2015 (with English Translation).

*Primary Examiner* — Vit W Miska
(74) *Attorney, Agent, or Firm* — Oblon, McClelland, Maier & Neustadt, L.L.P.

(57) ABSTRACT

A timepiece including a repeater mechanism including a barrel, a control mechanism including an actuating member for releasing the repeater mechanism, a release locking device which is activated automatically immediately after releasing the repeater mechanism, the release locking device including a release lever which is moveable between a rest position and a working position, the release lever including a first pin to block the barrel in the rest position and to release the barrel in the working position.

11 Claims, 6 Drawing Sheets

(56) References Cited

U.S. PATENT DOCUMENTS

| | | | | |
|---|---|---|---|---|
| 7,192,181 | B2 * | 3/2007 | Schmiedchen ..... | G04B 23/021<br>368/101 |
| 2007/0242568 | A1 | 10/2007 | Goeller | |
| 2012/0230165 | A1 | 9/2012 | Goeller | |

FOREIGN PATENT DOCUMENTS

| | | | |
|---|---|---|---|
| EP | 1 845 425 | A1 | 10/2007 |
| EP | 2 498 148 | A1 | 9/2012 |

* cited by examiner

TIMEPIECE COMPRISING A REPEATER MECHANISM AND A CONTROL MECHANISM WITH AN INTEGRATED RELEASE LOCK

The present invention relates to a timepiece comprising a repeater mechanism and a special control mechanism.

Minute repetitions have been known since Breguet times in the eighteenth century. They are intended to indicate the current time on request with the aid of different chimes. In the book *Théorie d'horlogerie* by Reymondin, Monnier, Jeanneret, Pelaratti, pages 219-224, there is an illustration of one of the most well-known examples of such a repeater mechanism, which uses two gongs to strike usually in each case the hours, then where applicable the quarters, and finally the residual minutes. The releasing of the strike-mechanism is actuated by a so-called winding slider which first tensions the mainspring of the strike-mechanism by means of a rack which meshes with a pinion arranged on the strike-mechanism barrel cover. At the end of the travel of this slider, the movement of the strike-mechanism is released, wherein the cooperation between inter alia racks and rungs determines the current time relating to the end of the travel of the slider.

Therefore, in conventional clocks comprising a repeater mechanism, the releasing of the strike-mechanism is always linked to the tensioning of the modified dedicated strike-mechanism barrel, and multiple releasing of the repeats is not possible. The user friendliness of such a strike-mechanism is limited by the fact that the actuation force required in order to push the winding slider is quite high because what is actually being carried out is the winding of a barrel, which is usually done by a crown. The narrow shape of the slider may lead to the finger slipping, and thus may lead to incorrect operation.

No locking device is present to rule out a further releasing of the strike-mechanism while the latter is moving, which makes actuation thereof particularly tricky. Release locking devices exist for strike-mechanisms, but these must usually be actuated in advance manually, for example with the aid of a blocking lever, in order to achieve the so-called muting.

The object of the present invention is to overcome these disadvantages.

A possibility was sought to develop a timepiece with a minute repetition which, unlike the conventional and known timepieces having a repeater mechanism, allows multiple releasing of the strike-mechanism without the mainspring of the strike-mechanism having to be tensioned again prior to each releasing and which more efficiently rules out operating errors.

Proceeding from the preamble of claim 1, this object is achieved by the characterizing features of claim 1.

The described invention makes it possible to deactivate the release function of an actuating member automatically after a first actuation until the end of the movement of the strike-mechanism. An integrated release locking means is thus created by ensuring that a released movement of the strike-mechanism can no longer be disrupted by possible operating errors: no further releasing of the strike-mechanism can be carried out by the actuating member while the strike-mechanism is running.

However, a timepiece comprising a repeater mechanism and a control mechanism according to the invention can allow this strike-mechanism to strike multiple times in succession since the releasing thereof is linked to a release locking device but at the same time is now completely separate from the winding of a preferably dedicated strike-mechanism barrel. Therefore, the mainspring of the strike-mechanism has to be retensioned only after a certain number of repeater operations.

The mainspring of the strike-mechanism is tensioned via a different device, so that multiple releasing of the repeater is permitted, wherein the releasing can preferably be achieved, for haptic reasons, via a push-button instead of a slider. The winding may in contrast be carried out via a customary crown.

The releasing of the repeater via a push-button, as in the case of chronographs, is more advantageous for haptic reasons. The sliders used to date in the casing require a considerable step as a support for the finger during the tensioning of the mainspring. If this step is not shaped to be particularly large and to provide a sufficient grip, the finger may slip, leading to incorrect operation. The installation of a push-button in the casing of a timepiece is much easier and requires a much simpler casing design in comparison to a slider. The impermeability to water and dust is easier to achieve and to guarantee when using a push-button than when using a slider.

Since the tensioning of the barrel is separate from the releasing of the strike-mechanism, the actuation force for releasing is considerably lower and thus activation thereof becomes easier. At the same time, therefore, a different winding member, such a customary crown for example, can be used for winding the barrel, which is more suitable for this purpose than a slider.

It is thus not only the reliability and robustness of the control mechanism for the strike-mechanism that is improved, but also the user friendliness thereof.

According to the invention, the release locking means is embodied by a special release lever which is movable between a rest position and a working position and which is preferably actuated by a push-button. In its rest position, the release lever blocks the free movement of the barrel, and in its working position this movement is then enabled. By virtue of a tip attached to the release lever, the latter can be locked in its working position by a clamping handle so that, immediately after actuation of the push-button, operating errors due to undesired further actuations are ruled out, and at the same time the movement of the strike-mechanism is released.

In the context of a minute repetition, the minute rack, which is driven last by the strike-mechanism control mechanism, also comprises an unlocking face which cooperates with an adjusting eccentric to lift the clamping handle and thus enable the release lever to return to its rest position at the end of the strike-mechanism movement.

In a preferred embodiment, the release lever furthermore comprises a flexible element which is preferably formed in one piece with a main part and which, as it travels between its rest position and its working position, determines the precise time to be struck, in that it preferably drives in rotation a switching cam provided with catches so as to enable racks provided with hooks to fall onto their respective rung. This step then takes place independently of any step of winding the barrel, since the barrel is still blocked during this step.

In a preferred embodiment, the release lever furthermore comprises a pin for locking the barrel in a blocking position. This pin preferably cooperates with another pin which is preferably on a gear of a movement drive chain that is in power transmission with the barrel. The lock is thus of modular construction, without any changes to the barrel being required.

In a preferred embodiment, a sliding guide device provided with stop faces is furthermore provided for the release lever so that the path between its rest position and its working position can be reliably repeated.

In a preferred embodiment, two completely dedicated separate kinematic chains are formed on the one hand for the winding of the barrel between a winding member and the barrel and on the other hand between an actuating member for the releasing of the strike-mechanism and the barrel. The entire control mechanism is thus of completely modular construction, and for example a conventional barrel and a corresponding winding mechanism could be used for the strike-mechanism. Since customary or conventional components can be reused, the proposed repeater mechanism can thus be integrated more easily in a timepiece and the production costs are also reduced as a result.

In a preferred embodiment, the barrel used no longer needs to have any special parts either for the winding thereof or for determining the current time and actuating the strike-mechanism. Completely separate time-determining and run-programming devices are to this end also of modular design, and thus the same advantages are obtained in terms of compatibility, possibility for integration, and lowering of production costs. Since no additional elements have to be placed on top of one another on the barrel in comparison to conventional strike-mechanism barrels, less space is also taken up in the height direction on the workplate for holding the entire strike-mechanism module, so that a timepiece that is thinner overall can be produced.

Advantageous embodiments of the invention are described in the dependent claims and in the description below.

A preferred example of embodiment of the invention will be described below with reference to the appended figures, which concern a novel minute repetition and the most important parts of the releasing and release locking device, wherein in particular a release lever is shown in its respective rest position and working position in various sequences during the movement of the strike-mechanism, and separate releasing and winding drive chains are illustrated.

In the figures:

FIG. 1 shows a view of the winding drive chain of a strike-mechanism barrel and of a movement drive chain of the strike-mechanism barrel, said movement drive chain being provided with a run regulator;

FIGS. 2A and 2B respectively show a view of a release lever in its rest position, emphasis being placed on the cooperation of pins for a locking device of the strike-mechanism barrel; and a more detailed view in sagittal section along section line A-A of the pin arrangement;

FIG. 3 shows a view of a release lever in its working position, emphasis now being placed on a further locking device for the release locking means;

FIGS. 4A and 4B respectively show a view of the device for releasing the various involved racks during the releasing of the strike-mechanism so that they can determine the corresponding time information by falling on their respective rungs, and a detailed view of the relative position of the teeth of a rack with respect to the teeth of the program gears during this;

The following figures each show the structure of the control mechanism with separate winding and releasing devices and the order of operations after the releasing of the strike-mechanism, which bring this control mechanism into various states during the movement of the strike-mechanism.

Figure 1:
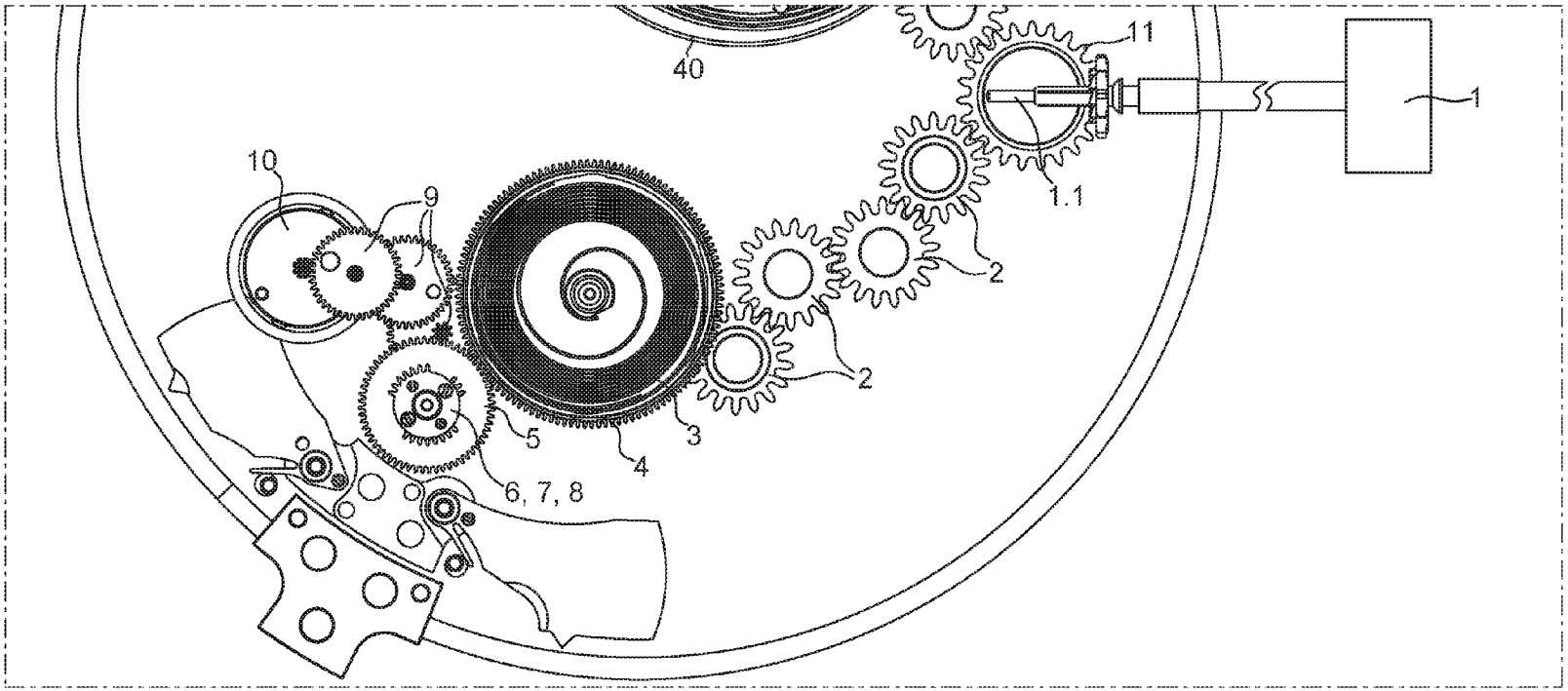

FIG. 1 shows, on the right-hand side, a preferred embodiment of the winding device used for tensioning the strike-mechanism. By rotating the winding shaft 1.1 of a conventional crown 1, the winding drive chain 2 is set in a rotational movement. As a result, a first mainspring 3 of the strike-mechanism barrel 4 is tensioned. As is known from a timepiece with automatic winding, the first mainspring 3 is equipped with a slipping bridle. By the same rotational movement, a second mainspring (not shown) of a running mechanism barrel 40 of the timepiece is also tensioned; this is also equipped with a slipping bridle. Both mainsprings are thus tensioned by the rotation of the winding shaft until the respective sliding torque is reached, and the power reserve is thus maximized, since the power required for the strike-mechanism is not shortened by the remaining power reserve. The advantage of the proposed combined winding lies in that the number of winding iterations is minimized; at the same time, however, the activation force required to turn the crown is slightly increased.

The branching between the two winding chains takes place at winding pinion 11, which acts as an intermediate element both for the winding of the strike-mechanism and of the movement mechanism. As a variant to the solution described here, it would also be possible to tension the two mainsprings also by different directions of rotation on the winding shaft, by adding a freewheel mechanism on an intermediate gear, or to produce a structure with two separate winding shafts.

A completely separate movement device for the strike-mechanism barrel 4, which movement device is completely decoupled from this winding mechanism, is illustrated on the left-hand side of FIG. 1. A driven gear 5 is in direct engagement with the strike-mechanism barrel 4. Located on this driven gear 5, oriented at a certain angle relative to one another, are three stacked program gears 6, 7 and 8 which have graduated toothings and which each mesh in a different switching plane. A movement drive chain 9, at the end of which there is a run regulator 10, is in engagement with the driven gear 5. This run regulator 10 may be a drum brake, a centrifugal governor, a magnetic regulator or another element which regulates the speed of the drive chain 9.

Figure 2B:
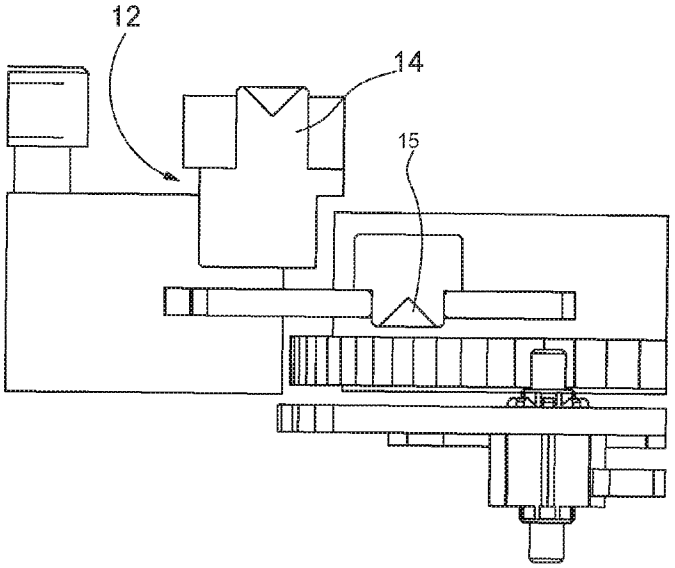
Figure 2A:
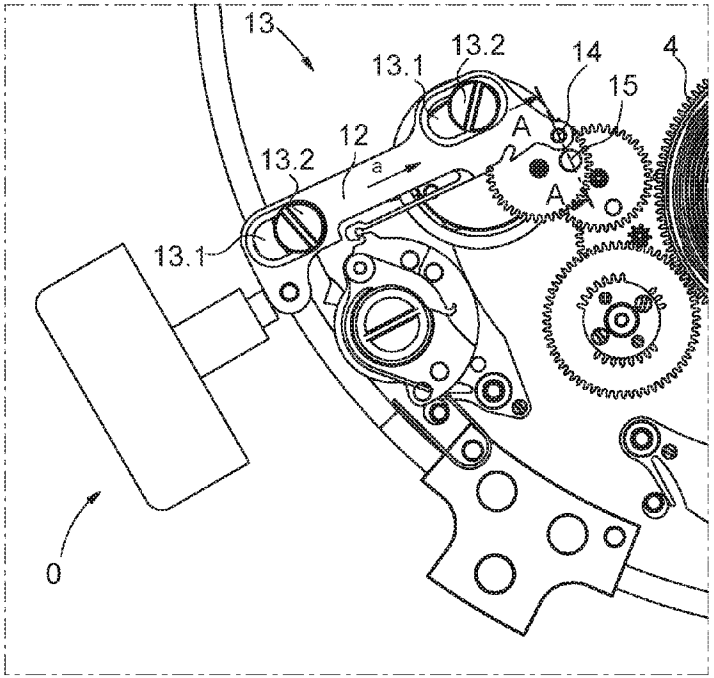

As shown in FIGS. 2A and 2B, by virtue of the decoupling of the winding of the strike-mechanism barrel and the releasing of the strike-mechanism, this releasing can now be actuated by a conventional push-button 0 instead of by a slider. A completely separate kinematic chain in comparison to the other kinematic chain between the crown 1 shown in FIG. 1 and the strike-mechanism barrel 4 has a release lever 12 which is actuated by the push-button 0 and which is responsible for the movement of the strike-mechanism barrel 4.

As shown in FIG. 2A, the free run of the barrel 4 is prevented by two pins 14 and 15 in the rest position of the release lever 12. Here, the pin 14 is located in the radial movement circle of the pin 15 and thus blocks the rotational movement and the run of the drive chain 9. These two pins are shown in detail in FIG. 2B, which shows a view in sagittal section along section line A-A of the mutual pin arrangement.

When the release lever 12 is pushed in the first arrow direction "a" by the push-button 0, the pin 14 fastened to the release lever 12 moves out of the radial movement circle of the pin 15 and thus enables the free run of the strike-mechanism barrel 4. Such a modular arrangement of the unlocking device for the movement of this barrel—that is to say the strike-mechanism barrel 4—which involves exclusively elements outside of the barrel makes it possible to continue to work with conventional barrel structures which have no additional or modified parts. The proposed repeater mechanism can thus be more easily integrated in a timepiece.

Figure 3:
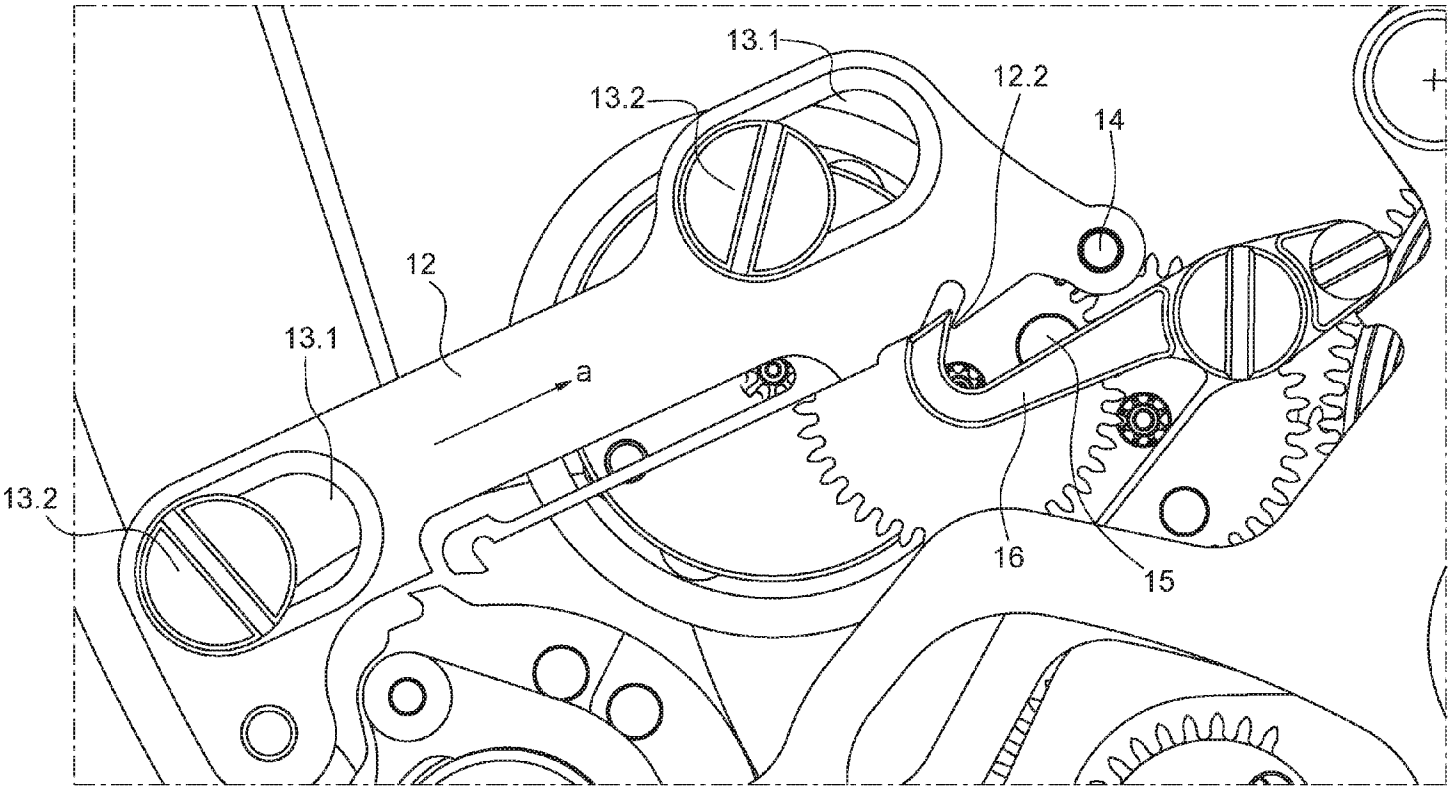

In the preferred embodiment shown in FIG. 2A, the release lever 12 furthermore has two guiding slots 13.1, into which there is screwed in each case a shoulder screw 13.2 for fastening to the workplate, and which limits the sliding movement of the release lever 12 along the first arrow direction "a", this direction corresponding to the longitudinal direction of the guiding slots 13.1. A sliding guide device 13 is thus formed between two stops which respectively define a first so-called rest position and a second so-called working position. The rest position is shown in FIG. 2A, whereas the working position is shown in FIG. 3, as indicated by the opposite position of the shoulder screws 13.2 in their respective guiding slots 13.1.

As soon as the release lever 12 has reached its maximum working position, it is held in this position by a clamping handle 16 which engages in a cutout behind a sticking tip 12.2. The proposed control mechanism thus offers an additional locking device, in which an integrated release locking means is ensured as soon as the push-button 0 has been actuated. The release lever 12 will remain in its working position until the end of the strike-mechanism run, even though the push-button 0 is preferably brought back into its rest position by a restoring spring and could thus be actuated again. However, such a further actuation would then no longer have any effect.

Figure 4B:
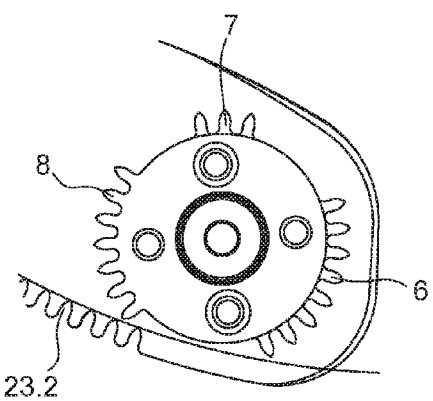
Figure 4A:
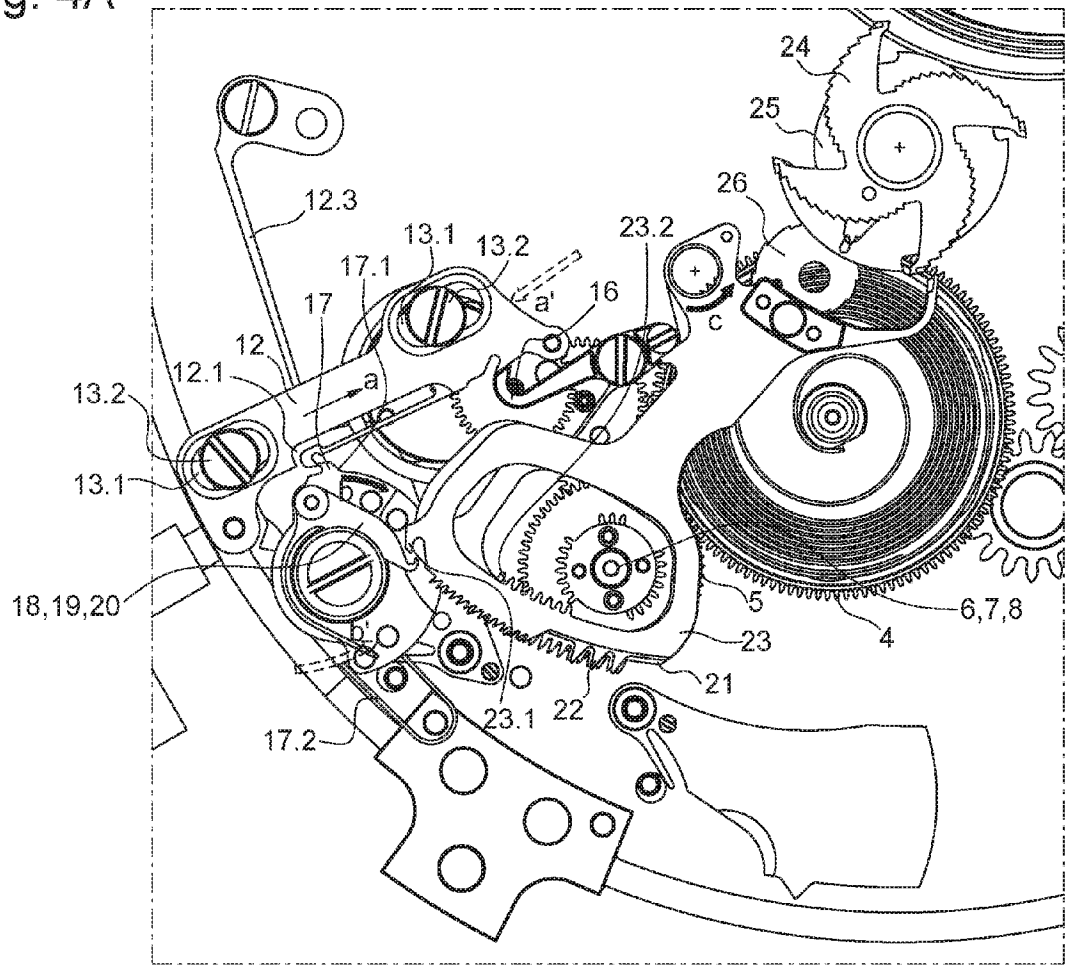

FIG. 4A shows how the sliding movement of the release lever 12 between its rest position and its working position is brought about. As shown in FIG. 4A, the shoulder screws 13.2 are located centrally in the elongate openings of the guiding slots 13.1. As it travels to the maximum working position along the first arrow direction "a", the release lever 12 must overcome a restoring force exerted along the second, opposite arrow direction "a" by the release restoring spring 12.3. In doing so, the release lever 12, with a flexible element 12.1 which is preferably formed in one piece therewith, rotates a switching cam 17 in the third arrow direction "b", wherein the restoring force exerted in the fourth, opposite arrow direction "b" by the switching cam spring 17.2 must also be overcome. By virtue of this rotation of the switching cam 17, the three superposed catches, that is to say the first catch 18, second catch 19 and third catch 20, are likewise rotated in the third arrow direction "b" and release the superposed racks, that is to say the first rack 21, the second rack 22 and the third rack 23. These three racks 21, 22, 23 then fall in arrow direction "c", driven by a spring force, onto their respective rung. In the preferred embodiment, the repeater mechanism consists of a minute repetition, and the three racks are respectively associated with hour, quarter and minute information. FIG. 4A accordingly shows the minute rung 24, quarter rung 25 and hour rung 26, which respectively cooperate with the third rack 23, the second rack 22 and the first rack 21. In the preferred embodiment shown, each rack is preferably provided with a hook which is respectively held in a blocked position by a corresponding catch. FIG. 4A shows only the hook 23.1 of the third rack 23, which cooperates with the third catch 20. The other hooks, which are located in different lower switching planes, are hidden therebelow. It can also be seen in this figure that the third rack 23 is provided with an inner toothing 23.2, which is intended to be driven by the minute program gear 8, as will be explained below with the aid of FIG. 5 which shows the movement of the strike-mechanism after the current time has been determined.

Before this, however, in this preferred embodiment, the inner toothing 23.2 of the third rack 23, and in actual fact the inner toothing of all racks, must move past the program gears without being blocked by the latter. Namely, the movement of the strike-mechanism barrel 4 in this middle position of the release lever 12 between the rest position and the working position is still blocked by the pins—that is to say the first pin 14 and the second pin 15—and, since the driven gear 5 is in the power transmission between the strike-mechanism barrel 4 and the second pin 15, this gear and thus all the program gears mounted thereon are also still blocked.

FIG. 4B shows the position in which the driven gear 5 must be located in order that neither the hour program gear 6 nor the quarter program gear 7 nor the minute program gear 8 can prevent the falling of the racks onto the rungs. To this end, the rest position of this driven gear 5 is defined as a function of the rotational position of the second pin 15 and the transmission ratios in the run transmission already at the time of assembly so that no toothing is located in the lower angle segment of the program gears. The inner toothing of the racks can thus never come into engagement with the program gears during this sequence of releasing the racks, but rather only later when the strike-mechanism barrel 4 is no longer blocked.

Before the release lever 12 has reached its maximum working position, the flexible element 12.1 again releases the switching finger 17.1 of the switching cam 17. The latter moves into its rest position counter to the third arrow direction "b", that is to say in the fourth arrow direction "b", on account of the restoring force of the illustrated switching cam spring 17.2.

As already explained with reference to FIG. 3, the release lever 12 is intended to be held in its maximum working position by the clamping handle 16 as soon as it has reached this position. The release lever 12 is then located in such a position on the left-hand side of FIG. 5, in which it permits the free movement of the barrel.

The three program gears mounted on the driven gear 5, that is to say the hour program gear 6, the quarter program gear 7 and the minute program gear 8, in their rotational movement in the sixth arrow direction "d", that is to say the running direction of the strike-mechanism barrel, successively transport the first rack 21, the second rack 22 and finally the third rack 23 to their rest position, which they reach by using their hooks to lift their respective first catch 18, second catch 19 and third catch 20 and remain there.

Figure 5:
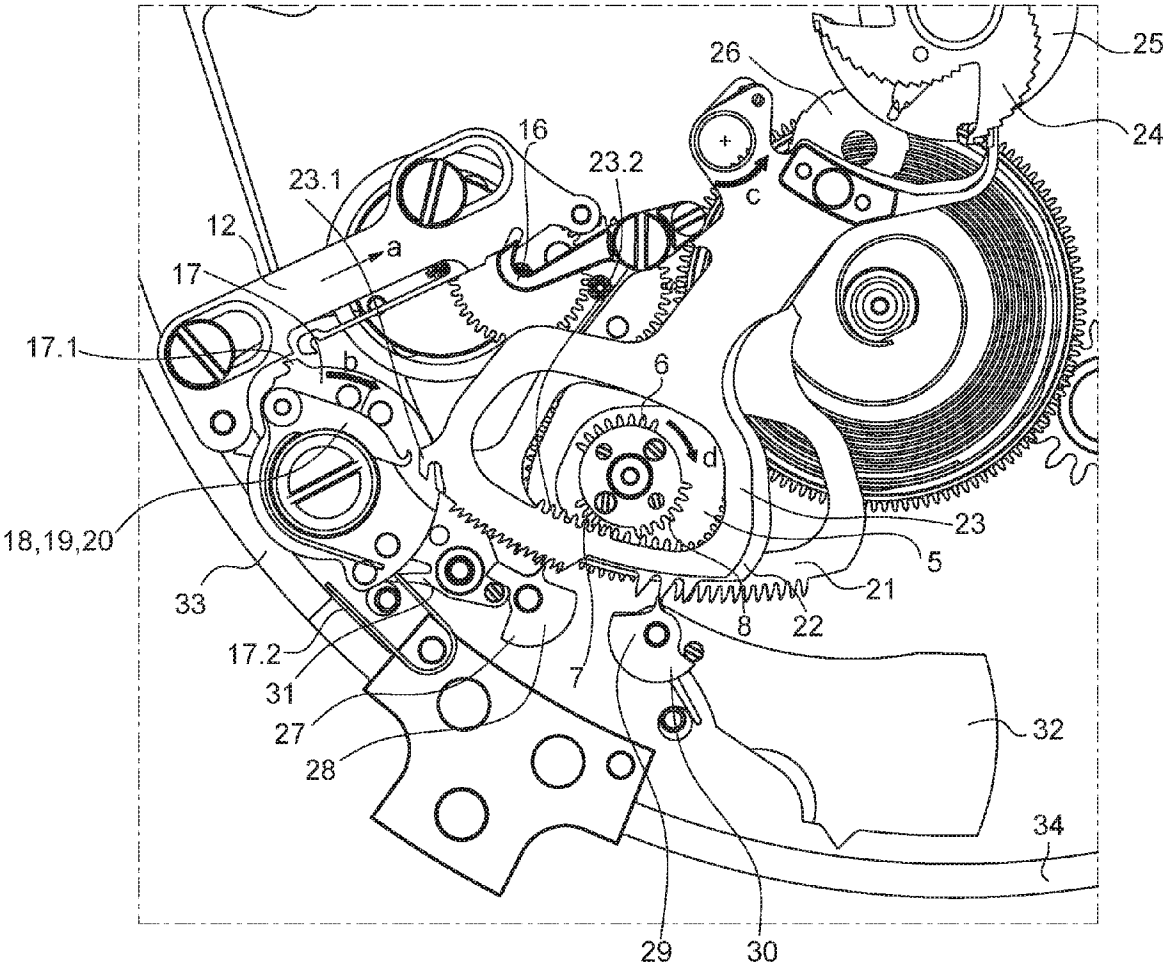
FIG. 5 shows a view of the cooperation of the racks with their respective program gears during the movement of the strike-mechanism, that is to say when the hammers are actually being actuated to strike the gongs.

As they travel to their rest position, the racks move their respectively associated first hammer lever 27, second hammer lever 28, third hammer lever 29 and fourth hammer lever 30, which in turn respectively allow the first hammer 31 and the second hammer 32 to strike the first gong 33 and the second gong 34. Such a configuration with two gongs is illustrated in FIG. 5, wherein the hour is indicated by a certain first chime, then the quarters are indicated by a combination of the first chime with a second chime, and finally the minutes are indicated by the second chime alone. However, a different configuration with, for example, only 3 levers which are each controlled by a rack and which once again would strike a dedicated hammer against a respective gong would also be conceivable in the context of the present invention.

Figure 6:
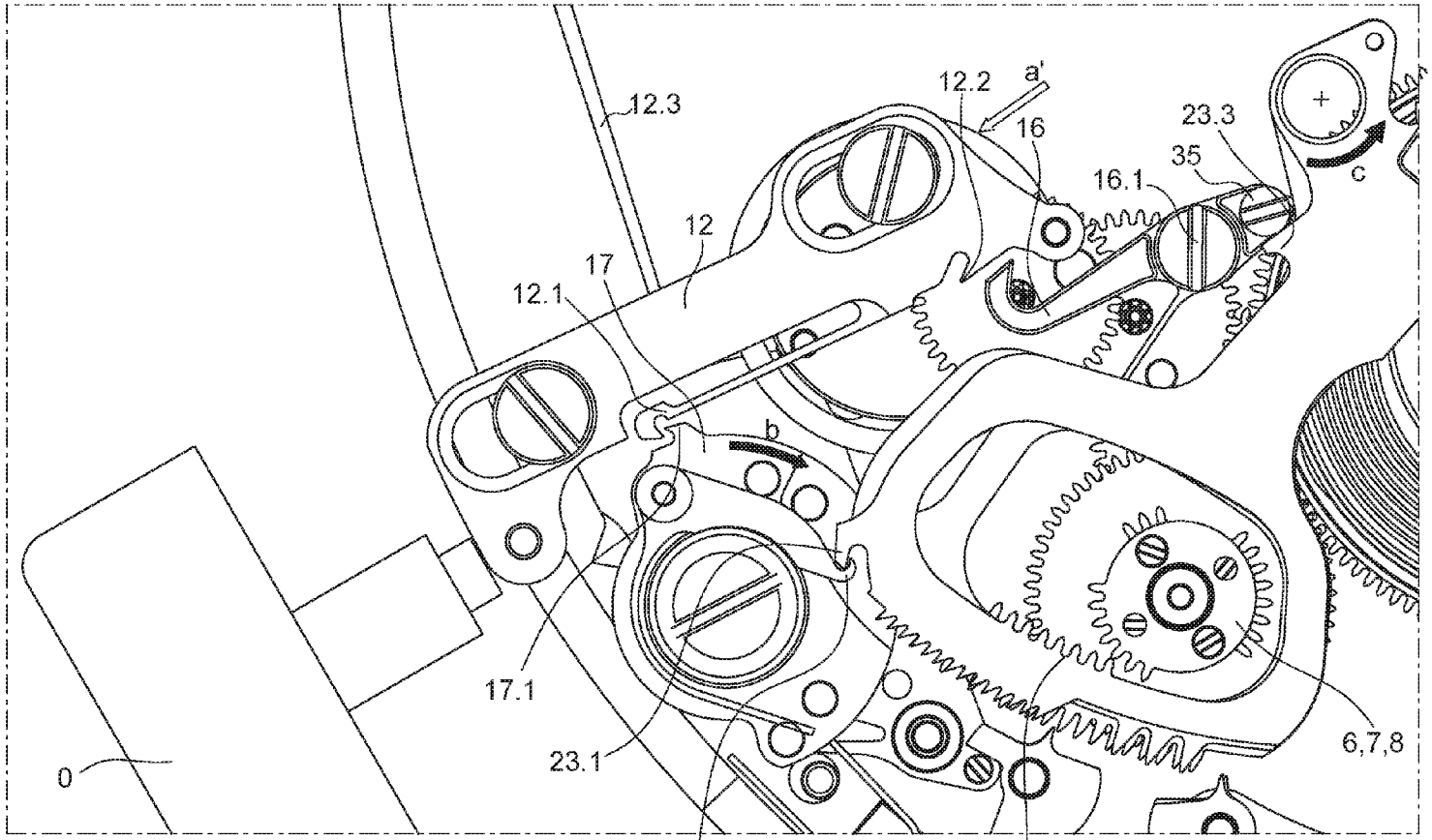
FIG. 6 shows a view of the same parts as in FIGS. 4 and 5, illustrating the unlocking of the release lever when it returns to its rest position.

As shown in FIG. 6, an unlocking face 23.3 arranged on the third rack 23, with the aid of an adjusting eccentric 35, starts to lift the clamping handle 16 shortly before reaching the end position of the third rack 23, where the hook 23.1 is again in engagement with the third catch 20. To this end, the adjusting eccentric 35 is preferably formed on the opposite side of the pivot axis 16.1 of the clamping handle 16. The tip of the clamping handle 16 is thus at a distance from the sticking tip 12.2 of the release lever 12. The latter can then, driven by the release restoring spring 12.3 shown only partially here, return to its rest position in the second arrow direction "a" counter to the first arrow direction "a". In doing so, the flexible element 12.1, which drives the switching cam during the releasing of the strike-mechanism, springs back over the switching finger 17.1 so as to be located in front of the latter in the rest position of the release lever.

The mechanism is thus back in the starting position, and the repeater can be triggered again if the push-button 0 is pressed.

In contrast to the repeaters known to date, which due to their design require the mainspring of the strike-mechanism to be tensioned again prior to each striking, the described invention makes it possible to allow a timepiece having a repeater mechanism to strike a number of times in succession. The mainspring of the strike-mechanism has to be tensioned again only after a certain number of repetition operations.

The proposed integrated release locking means prevents the repeater from being released a further time while it is already striking, which offers increased robustness and reliability, the modular structure of the release locking device making it possible to reuse customary parts of a timepiece movement (that is to say barrel and push-button) and thus to keep as low as possible the production costs and costs of integration in existing timepieces.

However, a person skilled in the art will understand from this description that the subject matter of the present invention encompasses other variants both for the release locking means and for the decoupling between the releasing device and the winding device, and is not only suitable for a minute repetition but rather can be used for all types of repeater strike-mechanism. In particular, it is possible to apply the described invention to all types of repeaters known in horology, such as, for example, quarter repetitions or minute repetitions. The blocking of the barrel could be achieved for example by the pivoting movement of a rocker which would come into engagement directly on the outer run toothing of the barrel or another gear, instead of by the cooperation between pins; conversely, the locking of the release lever in its working position could involve a pin instead of a tip. The unlocking device, which is intended to allow the return of the release lever at the end of the movement of the strike-mechanism, also need not necessary take the form of an adjusting eccentric and an unlocking face arranged on a minute rack, but rather could be coupled in general to the control member actuated last, so that this unlocking takes place only once all chimes have been struck.

For haptic reasons, the releasing of the repeater via a customary push-button (as in the case of chronographs) is more advantageous than the previously used sliders, but other actuating members, such as for example a bezel which then should be turned instead of pushed, would also be conceivable in the context of the invention. The same consideration applies to the winding member, which need not necessarily take the form of a customary crown but rather could also be formed for example by another push-button, wherein the sliding movement of the push-button will then later be converted in a driven chain into a rotational movement.

The detailed preferred embodiment mentioned above therefore serves only as an example and should not be construed as limiting in respect of the interpretation of the claims.

LIST OF REFERENCES

1 push-button (preferred embodiment for the actuating member)
1 crown
1.1 winding shaft
2 winding drive chain
3 first mainspring (strike-mechanism)
4 strike-mechanism barrel
5 driven gear
6 hour program gear
7 quarter program gear
8 minute program gear
9 movement drive chain
10 run regulator
11 winding pinion (intermediate member for the branching between strike-mechanism+running mechanism
12 release lever
12.1 flexible drive element (for switching cam 17)
12.2 sticking tip
12.3 release lever restoring spring
13 sliding guide device
13.1 guiding slot
13.2 shoulder screws
14 first pin
15 second pin
16 clamping handle
17 switching cam
17.1 switching finger
17.2 cam spring
18 first catch
19 second catch
20 third catch
21 first rack (hours)
22 second rack (quarters)
23 third rack (minutes)
23.1 hook
23.2 inner toothing
23.3 unlocking face
24 minute rung
25 quarter rung
26 hour rung
27 first hammer lever
28 second hammer lever
29 third hammer lever
30 fourth hammer lever
31 first hammer
32 second hammer
33 first gong
34 second gong
35 adjusting eccentric
40 running mechanism barrel
A-A sectional axis for FIG. 2B
a first arrow direction—unlocking of the movement of the barrel a' second arrow direction—restoring force for the release lever b third arrow direction—release of the racks b' fourth arrow direction—restoring force for the switching cam c fifth arrow direction—pivoting movement of the racks onto their respective rung for time determination d sixth arrow direction—strike-mechanism barrel drive

The invention claimed is:

1. A timepiece comprising:

a repeater mechanism comprising a barrel, a control mechanism comprising:

an actuating member for releasing said repeater mechanism, a release locking device which is activated automatically immediately after releasing said repeater mechanism, said release locking device comprising a release lever which is moveable between a rest position and a working position, said release lever comprising a first pin to block the barrel in the rest position and to release the barrel in the working position.

2. The timepiece according to claim 1, wherein the release locking device is arranged in a kinematic chain between the actuating member and the barrel.

3. The timepiece according to claim 2, wherein a movement drive chain is likewise arranged between the actuating member and the barrel, wherein the first pin of the release lever cooperates with a second pin attached to a gear of the movement drive chain in order to block the barrel in the rest position and to release the barrel in the working position.

4. The timepiece according to claim 1, wherein the release lever comprises at least one guiding slot in which a shoulder screw is guided in order to form a sliding guide device.

5. The timepiece according to claim 1, wherein the release lever further comprises a sticking tip which cooperates with a clamping handle in order to lock the release lever in the working position during the movement of the barrel.

6. The timepiece according to claim 1, wherein the release lever further comprises a flexible element which is responsible for determining the precise time before the movement of the barrel is enabled.

7. The timepiece according to claim 6, wherein the flexible element, during the travel between the rest position and the working position, brings about a pivoting movement of a switching cam provided with catches which are in engagement with hooks of racks in the rest position and thus allow the racks provided with hooks to fall on their respective rung.

8. The timepiece according to claim 7, wherein the repeater mechanism is a minute repetition which allows 3 different chimes to sound respectively for the hours, quarters and minutes, wherein the control mechanism to this end comprises three dedicated program gears, namely an hour program gear, a quarter program gear and a minute program gear, wherein the toothings of said program gears respectively come into engagement with the inner toothing of a first rack, a second rack and a third rack, which respectively fall on an hour rung, quarter rung and minute rung for time determination.

9. The timepiece according to claim 8, wherein the control mechanism comprises a modular driven gear which is in a power transmission between the barrel and a movement drive chain and on which the various program gears, that is to say said hour program gear, said quarter program gear and said minute program gear, are stacked, each of these program gears comprising graduated toothings and coming into engagement with the inner toothing of said first rack, second rack and third rack during the movement of the barrel, said racks being located one on top of the other, wherein the rest position of said driven gear when the strike-mechanism barrel is blocked is determined as a function of the position of said first pin and the transmission ratios of said movement drive chain in such a way that the inner toothings of said first rack, second rack and third rack can move past the various program gears when said racks fall on their respective rungs.

10. The timepiece according to claim 8, wherein the third rack comprises an unlocking face which cooperates with an adjusting eccentric, arranged on a clamping handle, as said release lever travels back from its working position to its rest position, in order to lift the clamping handle and thus enable said release lever to return to its rest position.

11. The timepiece according to claim 2, wherein the control mechanism has completely separate kinematic chains on the one hand between the actuating member and the barrel and on the other hand between a separate winding member and the barrel.

* * * * *